United States Patent [19]

Vykukal et al.

[11] 4,064,642

[45] Dec. 27, 1977

[54] WALKING BOOT ASSEMBLY

[75] Inventors: Hubert C. Vykukal; Alan B. Chambers, both of Los Altos; Roy H. St. John, Los Gatos, all of Calif.

[73] Assignee: The United States of America as represented by the National Aeronautics and Space Administration, Washington, D.C.

[21] Appl. No.: 753,976

[22] Filed: Dec. 23, 1976

[51] Int. Cl.[2] ..... A43B 7/16; A43B 5/04; A62B 17/00

[52] U.S. Cl. ..... 36/92; 36/119; 2/2.1 A

[58] Field of Search ..... 36/88, 89, 92, 97, 99, 36/80, 119; 9/330, 331, 332; 2/2.1 R, 2.1 A

[56] References Cited

U.S. PATENT DOCUMENTS

| | | | |
|---|---|---|---|
| 3,139,622 | 7/1964 | Schueller | 2/2.1 A |
| 3,751,727 | 8/1973 | Shepard et al. | 2/2.1 A |
| 3,798,800 | 3/1974 | Rathmell | 36/92 |
| 3,883,964 | 5/1975 | Check | 36/119 |

FOREIGN PATENT DOCUMENTS

| | | | |
|---|---|---|---|
| 20,610 | 11/1918 | France | 36/99 |

*Primary Examiner*—Patrick D. Lawson
*Attorney, Agent, or Firm*—Darrell G. Brekke; Armand McMillan; John R. Manning

[57] ABSTRACT

A walking boot assembly particularly suited for use with a positively pressurized spacesuit, including a bootie adapted to be secured to the foot of a wearer, an hermetically sealed boot for receiving the bootie having a walking sole, an inner sole and an upper portion adapted to be attached to an ankle joint of a spacesuit, a protuberance projected from the bootie and received within a recess formed in the inner sole of the boot for positioning the bootie relative to the boot, and releasable latching means for latching the protuberance in a received relationship with the recess.

8 Claims, 6 Drawing Figures

Fig. 1
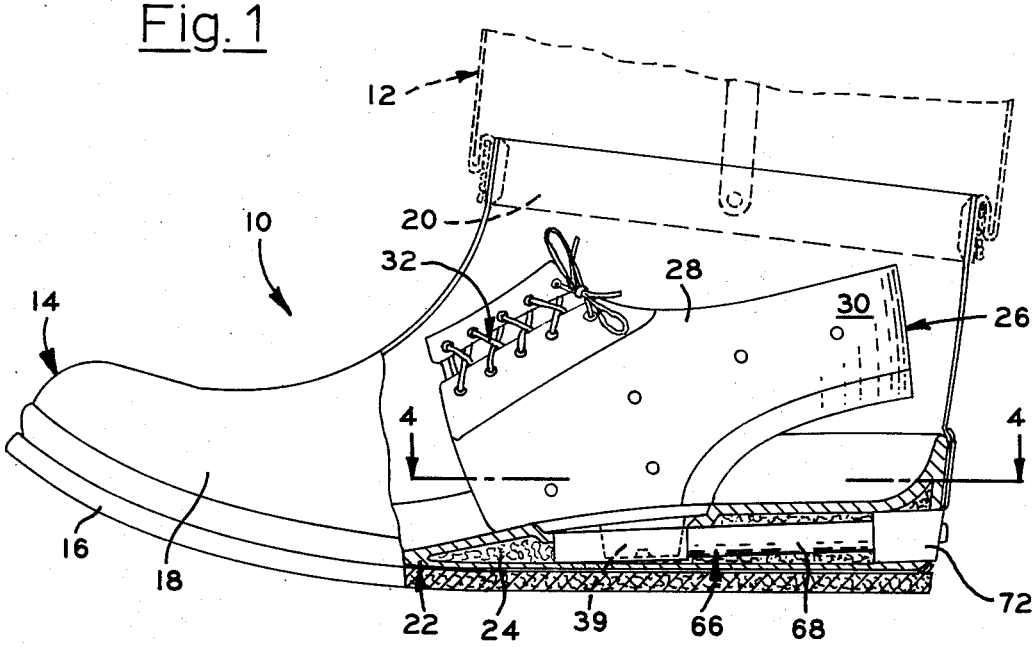
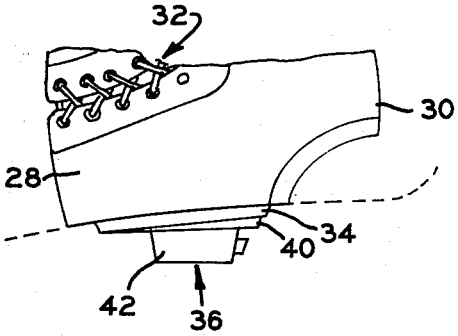
Fig. 3
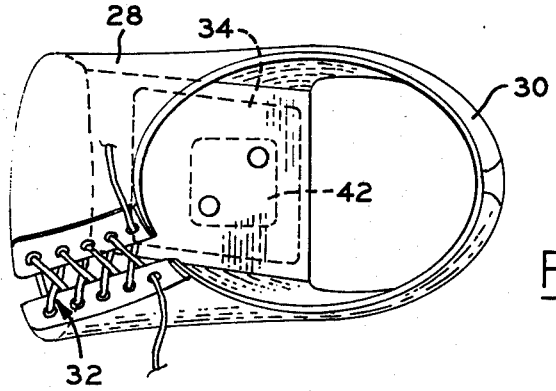
Fig. 2
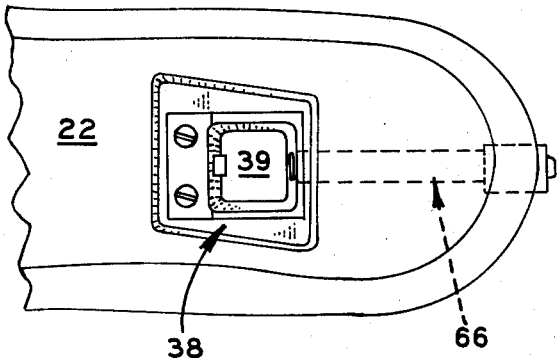
Fig. 4

Fig. 5
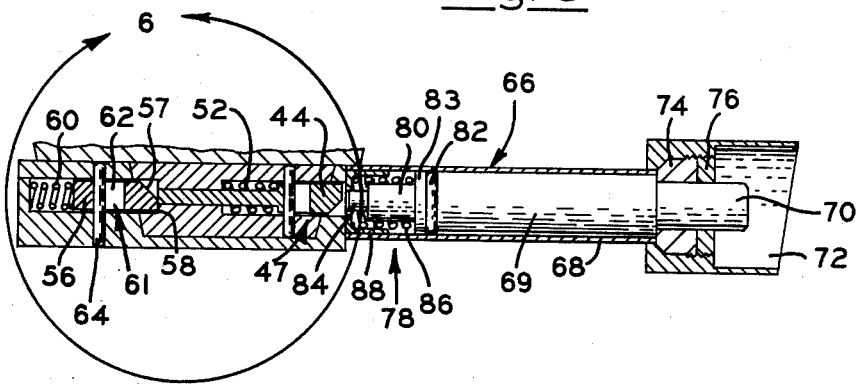
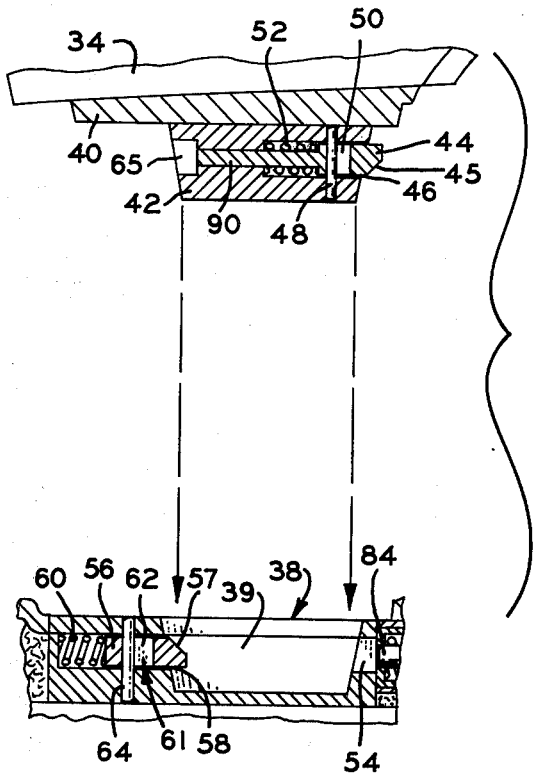
Fig. 6

WALKING BOOT ASSEMBLY

ORIGIN OF THE INVENTION

The invention described herein was made by employees of the United States Government and may be manufactured and used by or for the government for governmental purposes without the payment of any royalties thereon or therefor.

BACKGROUND OF THE INVENTION

1. Field of the Invention

The invention relates generally to footwear and more particularly to an improved walking boot assembly adapted for use with spacesuits and the like.

2. Description of the Prior Art

Spacesuits are generally expensive to fabricate and, generally, it is advantageous when a given spacesuit can be comfortably worn by different astronauts of varying sizes. In the past, boots for a spacesuit were often custom made for one particular wearer. In some cases the boots were made oversized and liners, sometimes referred to as "spacers," were employed to take up the excess volume. Spacers, of course, tend to have many drawbacks and they are seldom comfortable to wear, even for short periods of use. Moreover, spacers tend to impair foot ventilation and cause excessive perspiration.

It is, therefore, the purpose of the instant invention to provide an improved boot assembly for a spacesuit which can be worn by a plurality of wearers having mutually differing foot sizes.

OBJECTS AND SUMMARY OF THE INVENTION

It is therefore an object of the present invention to provide an improved boot assembly which overcomes the aforementioned difficulties and disadvantages.

It is another object to provide an improved boot assembly which accommodates feet of different sizes.

It is another object to provide for use in combination with a spacesuit an improved boot assembly adapted to fit the feet of wearers having different foot sizes.

It is another object to provide in combination with the spacesuit an improved boot assembly which includes an hermetically sealed boot attached to the ankle joint of a spacesuit, and a bootie adapted to be donned by a wearer, inserted into the boot and releasably latched to the inner sole of the boot for securing the bootie in fixed relation with the boot.

Another object is to provide an improved boot assembly which is particularly useful in combination with an hermetically sealed pressure suit, such as a spacesuit, although not necessarily restricted in use thereto, since the boot assembly may enjoy equal utility in terrestrial environments.

These and other objects and advantages are achieved through the use of a bootie comprising a truncated shoe, adapted to be donned by a wearer and characterized by a sole segment configured to be positioned between the ball and the heel of the foot of a wearer and having projected therefrom a protuberance configured to be received within a recess formed within an hermetically sealed walking boot, and a manually operable latching mechanism for releasably securing the protuberance in place within the recess, as will become more readily apparent in view of the following description and claims, in light of the accompanying drawings.

IN THE DRAWINGS

FIG. 1 comprises a partially sectioned, fragmented elevational view of a boot assembly, for a right foot, including a mated bootie and boot embodying the principles of the instant invention.

FIG. 2 is a top-plan view of the bootie shown in FIG. 1.

FIG. 3 is a fragmented, side elevational view of the bootie shown in FIGS. 1 and 2.

FIG. 4 is a fragmented top-plan view of the inner sole of the boot shown in FIG. 1.

FIG. 5 is a vertically sectioned, side elevational view taken through the interface of the mated boot and bootie shown in FIG. 1.

FIG. 6 is a fragmented, vertically sectioned exploded view of the structure circumscribed by line 6 in FIG. 5.

DETAILED DESCRIPTION OF THE PREFERRED EMBODIMENTS

Referring now to the drawings with more particularity wherein like reference characters designate like or corresponding parts throughout the several views, there is shown in FIG. 1 an improved boot assembly, generally designated 10, embodying the principles of the instant invention. While the boot assembly 10 is intended to be worn on a right foot, it should be apparent that a similar boot comprising a mirror image of the boot 10 may be worn on the left.

As illustrated in FIG. 1, the boot assembly 10 is connected with an ankle joint assembly, generally designated 12, of a pressure suit of the type frequently referred to as a spacesuit. Such an ankle joint assembly is more fully described in U.S. Letters Pat. application No. 753,965, filed Dec. 23, 1976, incorporated herein by reference thereto.

The boot assembly 10 includes an hermetically sealed walking boot 14. The walking boot, in turn, includes a walking sole 16, formed of a commercially available synthetic resin, and a flexible upper portion 18, for the sake of convenience hereinafter referred to simply as an "upper," fabricated from a suitable flexible, impervious material, connected with the ankle joint assembly 12 at an annulus 20 provided therefor.

As a practical matter, the upper 18 is fabricated from an impervious, laminated fabric, such as coated Nomex. Where desired, the upper 18 constitutes a continuation of the sleeve-like body employed as a flexible diaphragm for the ankle joint assembly 12.

Since the ankle joint assembly 12 is more fully described in the aforementioned U.S. Letters Pat. application No. 753,965, a detailed description thereof is omitted in the interest of brevity. However, it is to be understood that, as shown, the upper 18 is affixed to and supported by the annulus 20.

The boot 14 also includes an inner sole subassembly, generally designated 22, formed of materials found to be satisfactory for this purpose. The configuration of the inner sole 22 is suitable for supporting the foot of a wearer. As a practical matter, the inner sole 22 includes a wedge-shaped segment 24 which serves to provide adequate support for the heel and longitudinal arch of the foot of a wearer.

The walking boot assembly 10 further includes a bootie, generally designated 26. The bootie 26, in practice, is a truncated shoe of an open-toe, open-heel configuration. Thus the bootie is configured to include a band 28 adapted to be disposed in circumscribing relation with the arch and instep of the foot of a wearer, while a heel strap 30 is provided for maintaining the band 28 in a desired positional relationship with the foot of the wearer. Suitable lacing, generally designated 32, is provided for tightening the band 28 about the foot of the wearer in a manner which should readily be apparent.

It is important to note that the bootie 26 further includes a segment of a hard sole, designated 34, disposed beneath the arch of the foot of the wearer, to which is attached a protuberance 36, as best shown in FIG. 3.

This protuberance is configured to be received by a receptacle, generally designated 38, including a recess 39 provided in the inner sole 22 of the boot. Therefore, it should be apparent that the configuration of the recess 39 constitutes a mirror image of the configuration of the protuberance 36.

In order to provide for a suitable mounting of the protuberance 36, there is provided a wedge-shaped base 40 secured to the sole segment 34 of the bootie. Preferably, the base 40 is rigidly affixed to the sole segment 34 utilizing suitable fasteners, including adhesives and the like. Projected from the plane of the base plate 40 there is a latch housing 42 having angularly related planar side surfaces. As a practical matter, the housing 42 is of a truncated, pyramidal configuration and is formed of a suitable material such as metal or the like employing techniques fully understood by those familiar with the metal working arts. Of course, where so desired, the housing may be formed of suitable synthetic resins.

Within the housing 42 there is disposed an axially displaceable latching bolt 44 having a normally extended end including a cam face 45, defining an axially extended pawl. The bolt 44 is seated for reciprocatory motion within a suitable bore 46 and is retained within the bore by a pin-and-slot coupling 47. This coupling includes a pin 48 extended through an elongated slot 50 formed in the bolt, the length of which determines the throw of the bolt. The pin 48, of course, is secured within the latch housing 42 employing any suitable means.

Within the bore 46 there is disposed a compression spring 52. This spring is interfaced between the bolt 44 and the housing and serves to continuously urge the latching bolt 44 in axial displacement toward an extended relationship with the bore 46. It should, therefore, be apparent that the face 45 of the latching bolt 44 normally is resiliently supported in an extended relationship with the latch housing 42.

It is important to note that within the receptacle 38 there is provided a detent 54 adapted to cooperate with the latching bolt 44. The detent 54, as a practical matter, comprises an open end of a bore disposed in communication with the recess 39 and receives the extended end portion of the latching bolt 44. Thus a releasable coupling of the protuberance 36 within the receptacle 38 is achievable.

In order to more firmly couple the protuberance 36 with the receptacle 38, it has been found desirable to provide another latching bolt 56 in spaced relation with the bolt 44. The bolt 56 is disposed within the inner sole 22 of the boot 14 and is seated in a tubular bore 58 coaxially aligned with the detent 54 and communicating with the recess 39. Like the latching bolt 44, the latching bolt 56 includes a normally projected end having a cam face 57 defining an axially extended pawl. The bolt is resiliently supported for axial reciprocation. This is achieved through a use of a compression spring 60 seated within the bore 58 and disposed in an abutting relationship with one end of the latching bolt 56 for purposes of urging the bolt 56 in axial extension into the recess 39 of the receptacle 38. A pin-and-slot coupling 61 is provided for limiting the throw of the bolt 56. The coupling 61 includes a slot 62 formed in the latching bolt 56 and a rigid pin 64 extended therethrough. Thus the latching bolt 56 is retained within the bore 58 while axial displacement thereof is accommodated.

In order to receive the extended end portion of the latching bolt 56, there is provided within the latch housing 42 a detent 65. This detent is arranged in coaxial alignment with the latching bolt 44 and serves to receive the adjacent end portion of the latching bolt.

As a practical matter, a mated relationship between the protuberance 36 and the receptacle 38 is achieved by aligning the latch housing 42 with the recess 39 and then inserting the housing into the recess 39. Therefore, it is to be understood that the cam faces 45 and 57 of the extended end portions of the latching bolts 44 and 56, respectively, engage the adjacent surfaces of the recess and housing, respectively, so that the latching bolts are cammed in retracting displacement against the applied forces of the supporting springs until such time as the latching bolts become aligned with their respective detents. Upon becoming aligned, the bolts 44 and 56 are forced by their supporting springs 52 and 60 into seated relation with the detents 54 and 65.

In order to accommodate a release of the protuberance 36 from its mated relationship with the receptacle 38, there is provided in the boot a manually operable release mechanism, generally designated 66, FIGS. 1 and 5.

The release mechanism 66 includes a tubular shell 68, of a generally cylindrical configuration. The shell 68 is embedded in the inner sole 22 of the walking boot 14, in coaxial communication with the detent 54 and bore 58, and communicates with the surface of the heel portion of the boot. Seated within the shell 68 there is an axially displaceable plunger 69. The plunger 69 comprises a cylindrical body having a first end portion 70 of a reduced diameter extended axially from the shell 68 and the heel portion of the boot 14. The end portion 70 of the plunger 69 is positioned to serve as a manually operable button, and is disposed within a protective housing 72 provided therefor. The shell 68 is hermetically sealed by a suitable seal 74 disposed in concentric relation with the end portion 70 of the plunger 69 and supported by a retainer ring 76. Where desired, the retainer ring 76 is provided with a screw threaded periphery received within a mating thread provided internally of the housing 72, as illustrated in FIG. 5.

Near the end of the plunger 69, opposite its end 70, there is provided a latching bolt actuator, generally designated 78. The actuator 78 includes an end portion 80 of the plunger 69, the diameter of which is substantially reduced with respect to the diameter of the body of the plunger. As a practical matter, the shell 68 is further hermetically sealed by an O-ring 82 supported in place by an annular retainer 83 disposed in concentric relation with the end portion 80 of the plunger 69. As shown, the O-ring 82 is interposed between the retainer 83 and a shoulder, not designated, defined about the periphery of the plunger 69.

Also included in the actuator 78 is a retractor pin 84. This pin is extended in coaxial relation with the end portion 80 of the plunger 69. The retractor pin, where so desired, is formed simply by machining the end portion 80 of the plunger 69 to yet a smaller diameter to provide a pin-like structure projected from the end thereof. As a practical matter, the diameter of the retractor pin 84 is such that it is readily received within the adjacent detent 54. A compression spring 86 is seated in the shell 68 in concentric relation with the end portion 80 and abutting relation with the annular retainer 83. The spring 86 is further supported by a spring retainer 88 provided in the end of the shell 68, in juxtaposition with the detent 54. It is to be understood that the retainer 88 also includes an annulus, not designated, for accommodating passage of the retractor pin 84 while supporting the spring in compression. It should, therefore, be apparent that the plunger 69 is spring biased in a manner such that the pin 84 normally is retracted relative to the detent 54, while the end portion 70 thereof is urged in displacement outwardly from the heel portion of the boot.

It also is important to appreciate that the latching bolt 44 includes, as a part of the release mechanism 66, an axially extended end portion 90. This portion of the bolt is extended in coaxial alignment with the detent 65 and communicates therewith. Hence, it is to be understood that as axial displacement is imparted to the latching bolt 44 against the applied forces of the spring 52, the extended portion 90 of the latching bolt is projected into the detent 65.

Assuming that the protuberance 36 is seated within the receptacle 38, a manual depression of the end portion 70 of the plunger 69 causes the retractor pin 84 to be displaced against the adjacent end of the latching bolt 44, for thus imparting thereto retracting displacement. As the retracting displacement is imparted to the latching bolt 44, the extended portion 90 thereof engages the adjacent end portion of the latching bolt 56 for thus causing the latching bolt 56 to be axially displaced against the applied forces of the compression spring 60. Thus the latching bolts 44 and 56 are simultaneously released for accommodating an extraction of the protuberance from the receptacle.

OPERATION

It is believed that in view of the foregoing description, the operation of the device will readily be understood and it will be briefly reviewed at this point.

In order to don the boot assembly 10, a wearer simply inserts a foot into the bootie 26 and tightens the band 28 about the instep thereof, simply by tightening the laces 32. The wearer now inserts his foot downwardly through the upper 18 into the boot, whereupon the protuberance 36 is caused to become aligned with the receptacle 38. Continued inward motion of the wearer's foot, relative to the boot 14, causes the housing 42 of the protuberance 36 to enter the recess 39 of the receptacle 38 whereupon the latching bolts 44 and 56 are simultaneously cammed in retraction against applied forces of the springs 52 and 60, respectively, as the faces 45 and 57 engage the opposite surfaces of the recess 39 and housing 42, respectively.

Once the protuberance 36 seats fully within the receptacle 38, alignment between the detents 54 and 65 and the respective latching bolts 44 and 56 is achieved. The compression springs 52 and 60 now serve to drive the latching bolts 44 and 56, respectively, into their respective detents for thus achieving therefor a latched relationship. Thus the protuberance 36 is releasably secured within the receptacle 38.

In order to effect a release of the protuberance 36 from the receptacle 38, the end portion 70 of the plunger 69 is depressed for thus causing the plunger 69 to advance axially along the shell 68. This advancement of the plunger causes the retractor pin 84 to enter the detent 54 and engage the end portion of the latching bolt 44 for retracting the latching bolt from the detent against the applied force of the spring 52. Of course, the extended end portion 90 of the latching bolt 44 engages the adjacent end surface of the latching bolt 56. Continued displacement of the plunger 69 now causes the latching bolt 56 to be forced in retracting displacement against the applied forces of the spring 60, for thus causing the latching bolt 56 to be retracted from the detent 65. Once the latching bolts 44 and 56 are retracted from their respective detents, the protuberance 36 is released for extraction from the receptacle 38. The bootie 26, and hence the foot of the wearer, is thus released for extraction from the walking boot 14.

Although the invention has been herein shown and described in what is conceived to be the most practical and preferred embodiment, it is recognized that departures may be made therefrom within the scope of the invention, which is not to be limited to the illustrative details disclosed.

What is claimed is:

1. In a walking boot assembly, the combination comprising:
   A. a bootie having a sole and an upper portion adapted to be attached to a foot of a wearer;
   B. a walking boot having an inner sole and an upper portion for receiving said bootie; and
   C. coupling means for releasably attaching said bootie to the walking boot, said coupling means including a protuberance affixed to the sole of said bootie, a recess defined in the inner sole of said boot for receiving said protuberance in mated relation, and means for securing said protuberance in mated relation with said recess.

2. The combination of claim 1 wherein said coupling means includes a spring biased latching pawl and a detent for receiving said pawl.

3. The combination of claim 1 wherein said bootie comprises a truncated shoe having a sole adapted to be received beneath the longitudinal arch of the foot of a wearer, and means including a band adapted to be passed about the foot for securing said sole in place relative to said arch.

4. The combination of claim 3 wherein said coupling means further includes:
   A. a retractable pawl mounted in said protuberance and extended therefrom;
   B. means defining in said recess a detent for receiving said pawl; and
   C. means for continuously urging said pawl into an extended relationship with said protuberance.

5. The combination of claim 4 wherein said coupling means further includes:
   A. a retractable pawl extended into said recess;
   B. means defining in said protuberance a detent for receiving said pawl;
   C. means for continuously urging said pawl into an extended relationship with said recess; and
   D. manually operable means mounted on said boot for simultaneously retracting said pawls.

6. The combination of claim 5 wherein each of said pawls includes a spring biased bolt resiliently supported for axial displacement and said means for simultaneously retracting said pawls comprises an axially displaceable rod mounted in said boot and projected therefrom in coaxial alignment with the pawls and disposed in abutting engagement with at least one of the pawls.

7. The combination of claim 6 wherein the upper portion of said boot is connected to one leg of a spacesuit and the boot comprises an hermetically sealed boot.

8. In combination with a spacesuit an improved boot assembly comprising:

A. a bootie adapted to be donned by a wearer of the spacesuit including a segment of sole adapted to be positioned between the ball and the heel of the foot of the wearer and an adjustable band for securing the segment of the sole to the foot;

B. an hermetically sealed boot including a walking sole, an inner sole and an upper portion formed of a flexible, impermeable material connected to one leg of said suit;

C. foot positioning means for positioning the foot in fixed relation with said boot including a protuberance projected from the segment of the sole and means defining a recess in the inner sole of said boot for receiving said protuberance;

D. latching means for securing said protuberance in said recess including a first and a second pawl, means defining a first and second detent for receiving each of said pawls and a first spring biased pawl mounted in said protuberance and resiliently projected therefrom, means defining in said recess a detent for receiving said pawl in mated relation, a second spring biased pawl mounted in the inner sole of said boot and resiliently projected into said recess, and means defining in said protuberance a detent for receiving said second pawl; and E. manually operable means mounted on said boot for simultaneously retracting said first and second pawls including an axially extensible rod disposed in coaxial alignment with said pawls when said protuberance is received in said recess engageable with at least one of said pawls for retracting the pawls as axial displacement is manually imparted thereto.

* * * * *